US007922057B2

(12) United States Patent
Ambjörnsson et al.

(10) Patent No.: US 7,922,057 B2
(45) Date of Patent: Apr. 12, 2011

(54) STAPLER WITH BUILT-IN STAPLE REMOVER

(75) Inventors: Frank Ambjörnsson, Hestra (SE); Bengt Ivarsson, Åsenhöga (SE)

(73) Assignee: Isaberg Rapid AB (SE)

( * ) Notice: Subject to any disclaimer, the term of this patent is extended or adjusted under 35 U.S.C. 154(b) by 210 days.

(21) Appl. No.: 12/282,792

(22) PCT Filed: Jan. 10, 2007

(86) PCT No.: PCT/SE2007/000013

§ 371 (c)(1),
(2), (4) Date: Jan. 9, 2009

(87) PCT Pub. No.: WO2007/106004

PCT Pub. Date: Sep. 20, 2007

(65) Prior Publication Data

US 2010/0006618 A1 Jan. 14, 2010

(30) Foreign Application Priority Data

Mar. 13, 2006 (SE) ..... 0600540

(51) Int. Cl.
*B25C 5/00* (2006.01)

(52) U.S. Cl. ..... 227/120; 227/119; 227/132

(58) Field of Classification Search ..... 227/120, 227/119, 132

See application file for complete search history.

(56) References Cited

U.S. PATENT DOCUMENTS

| | | | | |
|---|---|---|---|---|
| 2,724,832 | A * | 11/1955 | Marano | 227/125 |
| 3,563,513 | A * | 2/1971 | Rubin et al. | 254/28 |
| 4,002,281 | A * | 1/1977 | Hsu | 227/63 |
| 5,690,268 | A * | 11/1997 | Evans et al. | 227/156 |
| 6,062,456 | A * | 5/2000 | Patti et al. | 227/63 |
| 6,286,745 | B1 * | 9/2001 | Ackeret | 227/76 |
| 6,460,433 | B1 * | 10/2002 | Ackeret et al. | 81/440 |
| 6,493,893 | B1 * | 12/2002 | Ackeret | 7/160 |
| 6,708,360 | B2 * | 3/2004 | Ackeret | 7/160 |
| 6,779,425 | B2 * | 8/2004 | Ackeret et al. | 81/440 |
| 2001/0037528 | A1 * | 11/2001 | Ackeret | 7/160 |
| 2003/0088921 | A1 * | 5/2003 | Ackeret | 7/160 |
| 2004/0040999 | A1 * | 3/2004 | Ackeret | 227/63 |

FOREIGN PATENT DOCUMENTS

| | | |
|---|---|---|
| JP | 10-166282 | 6/1998 |
| JP | 2000-210883 | 8/2000 |

OTHER PUBLICATIONS

"International Application Serial No. PCT/SE2007/000013, International Search Report mailed Mar. 23, 2007", 2 pgs.

* cited by examiner

*Primary Examiner* — Brian D Nash

(74) *Attorney, Agent, or Firm* — Schwegman, Lundberg & Woessner, P.A.

(57) ABSTRACT

Embodiments include a stapler with a built-in staple remover, the staple remover movable between a non-operational position where it is retracted in a stapler body of the stapler and locked by a locking device and an operational position where it is partly extended from the stapler body, the staple remover being acted upon by a first elastic unit which is tensioned when the staple remover is in the non-operational position and which pushes the staple remover to the operational position when the locking device is released in the non-operational position.

15 Claims, 8 Drawing Sheets

STAPLER WITH BUILT-IN STAPLE REMOVER

RELATED APPLICATIONS

This application is a nationalization under 35 U.S.C. 371 of PCT/SE2007/000013, filed Jan. 10, 2007 and published as WO 2007/106004 A1, on Sep. 20, 2007, which claimed priority under 35 U.S.C. 119 to Sweden Patent Application Serial No. 0600540-9, filed Mar. 13, 2006; which applications and publication are incorporated herein by reference and made a part hereof.

TECHNICAL FIELD

The present invention relates to a stapler using staples for stapling together a workpiece, particularly a sheaf of papers, which stapler comprises a base part against which the workpiece is placed, a magazine part in which the staples are stored, and a built-in staple remover arrangement comprising a staple remover which is movable between a non-operational first position where it is retracted in the stapler body and is locked therein by a locking device and an operational second position where it is partly extended from the stapler body.

STATE OF THE ART

Staplers of the kind indicated above are previously known but exhibit with respect to the aforesaid staple remover arrangement a large number of disadvantages. A first such disadvantage is that the staple remover is moved manually from its retracted position to the extended position, which may mean that it does not reach the fully extended position, in which case it will not function satisfactorily when it is to be used for its purpose. A second disadvantage is that it is locked by a locking device which comprises parts which are released by the staple remover being manipulated. This means that the locking device when the staple remover is in the operational position can be released when the staple remover is used for its purpose whereby it may be inadvertently moved to a non-operational position, which the user may find very irritating. A third disadvantage is that when the staple remover is moved manually to its locked retracted position, it may, without the user realising it, not reach a fully retracted position, which may cause inconvenience for the user. A further disadvantage is that in its extended state the staple remover is unstable in that its fastening to the stapler does not prevent its moving in directions transverse to its longitudinal direction.

Problem

There is thus a need for a stapler which has a staple remover arrangement with a staple remover which is not moved manually between the retracted position and the extended position, which does not have a locking device which is released by the staple remover being manipulated, which cannot be moved to a not fully retracted position unnoticed by the user, and which in an extended state is not unstable in a direction transverse to its longitudinal direction.

Solution

The present invention overcomes the abovementioned disadvantages by proposing a stapler of the kind indicated in the introduction which is characterised in that the staple remover is acted upon by a first elastic means which is tensioned when the staple remover is in a non-operational position and which moves the staple remover to the second position when the locking device is released in the locked retracted position and in that the locking device locks the staple remover in the operational second position.

The invention is further characterised in that the locking device is moved from a locked position to an unlocked position without the staple remover being manipulated.

The present invention is further characterised in that the elastic means moves the staple remover to the extended position if the latter when pushed in from an extended position does not reach the locked retracted position.

The present invention is further characterised in that when the staple remover is in an extended state it is connected to the stapler in such a way that it can only move marginally in a direction transverse to its longitudinal direction.

The present invention is further characterised in that the locking device is held in a locked position by a second elastic means.

Finally, the present invention is characterised in that the first elastic means takes the form of a coil spring.

BRIEF DESCRIPTION OF THE DRAWINGS

An example of an embodiment of the invention is described below with reference to the attached drawings, in which.

PREFERRED EMBODIMENT EXAMPLE

Figure 1:
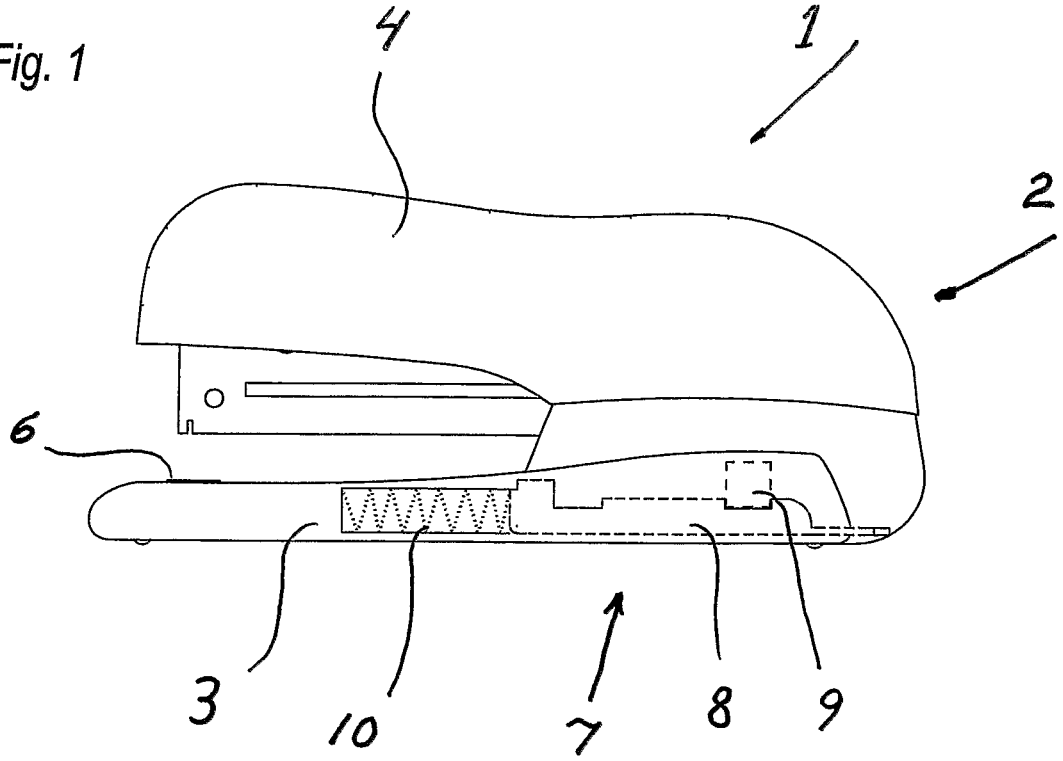
FIG. 1 is a schematic view of a stapler with a staple remover in a retracted state.
Figure 2:
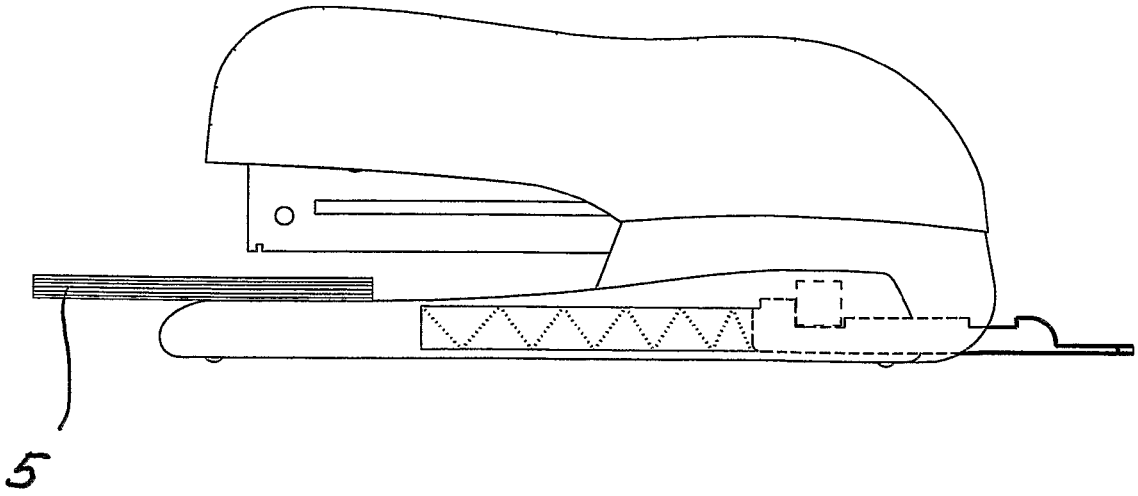
FIG. 2 is a view corresponding to FIG. 1 in which the staple remover is in an extended state.

FIGS. 1 and 2 depict schematically a stapler 1 comprising a body 2 which itself comprises a base part 3 and a magazine part 4. A workpiece 5 is placed against the base part 3 for stapling by means of staples which are not visible in the drawings but are accommodated in the magazine part. The workpiece preferably takes the form of a sheaf of papers. The stapling is usually effected by the magazine part being moved towards the workpiece, resulting in a staple being driven into the workpiece and being bent against an anvil 6 placed on the base part. As this function is generally known to everyone and does not form part of the present invention, it is not described further. The drawings also depict schematically a staple remover arrangement 7 comprising a staple remover 8 and a locking device 9 represented by broken lines, and a first elastic means 10 represented by dotted lines. In FIG. 1, the staple remover is in a retracted first position and is locked by the locking device, and in FIG. 2 the staple remover is in an extended second position and is here again locked by the locking device. The drawings show the arrangement situated in the base part and directed rearwards, but it is immaterial for the invention whether the arrangement is situated in the magazine part or whether it is directed forwards.

Figure 4:
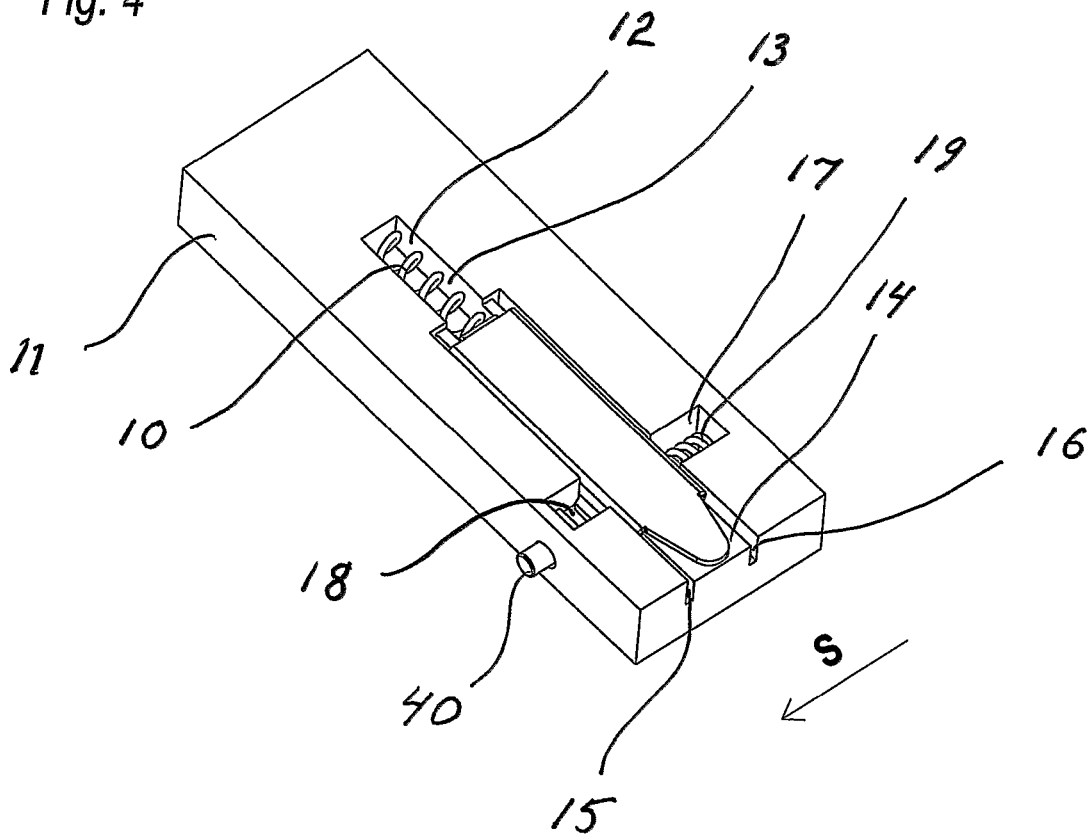
FIG. 4 is a separate element of the stapler in which the staple remover is depicted in detail in a retracted state.
Figure 5:
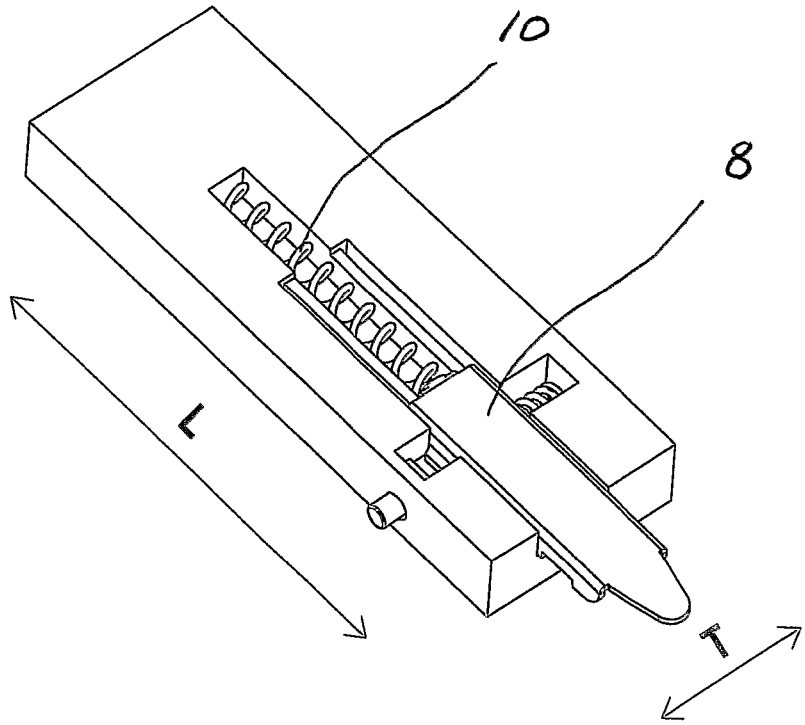
FIG. 5 is a view corresponding to FIG. 4 in which the staple remover is in an extended state.
Figure 6:
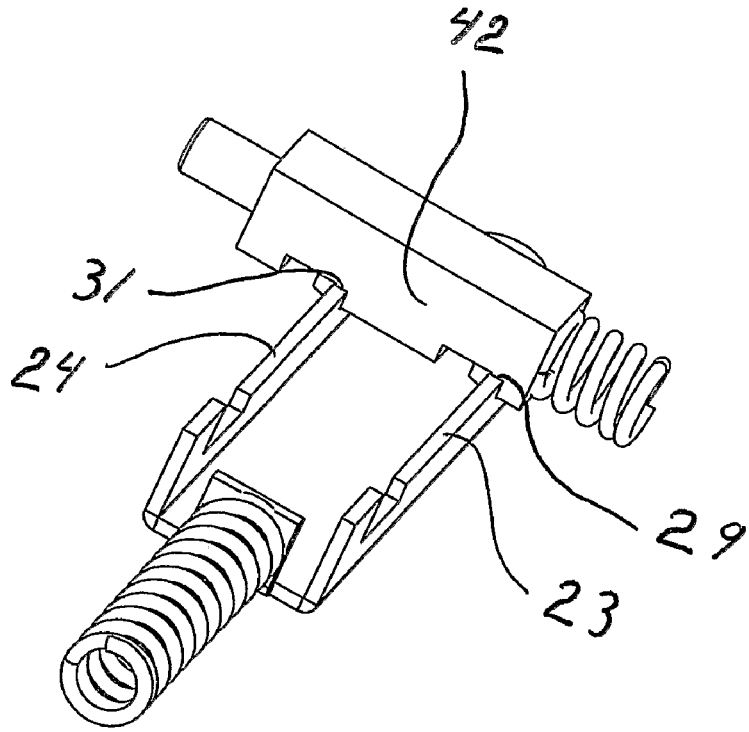
FIGS. 6-11 depict parts essential to the invention in a number of different states.
Figure 7:
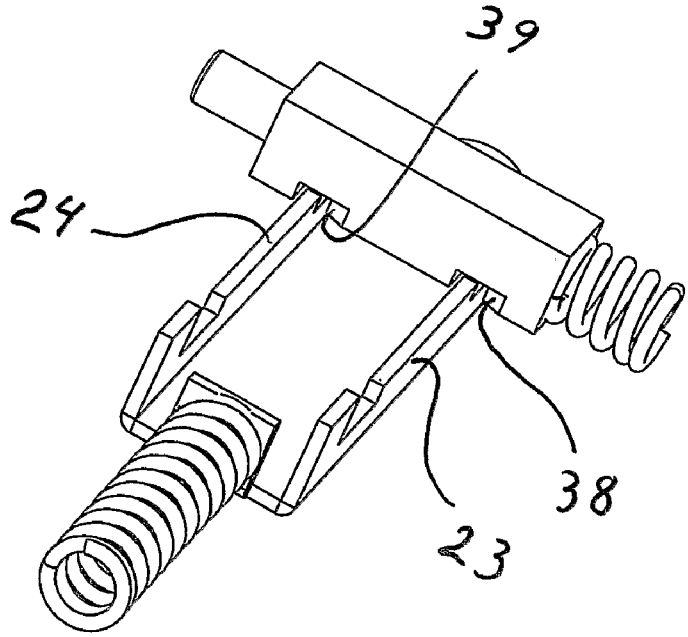
Figure 8:
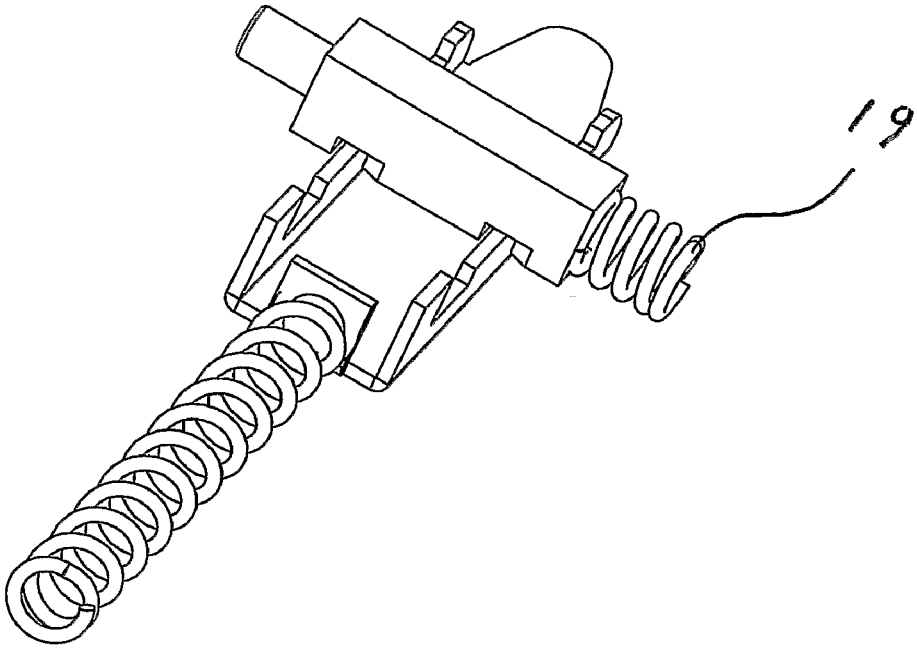
Figure 9:
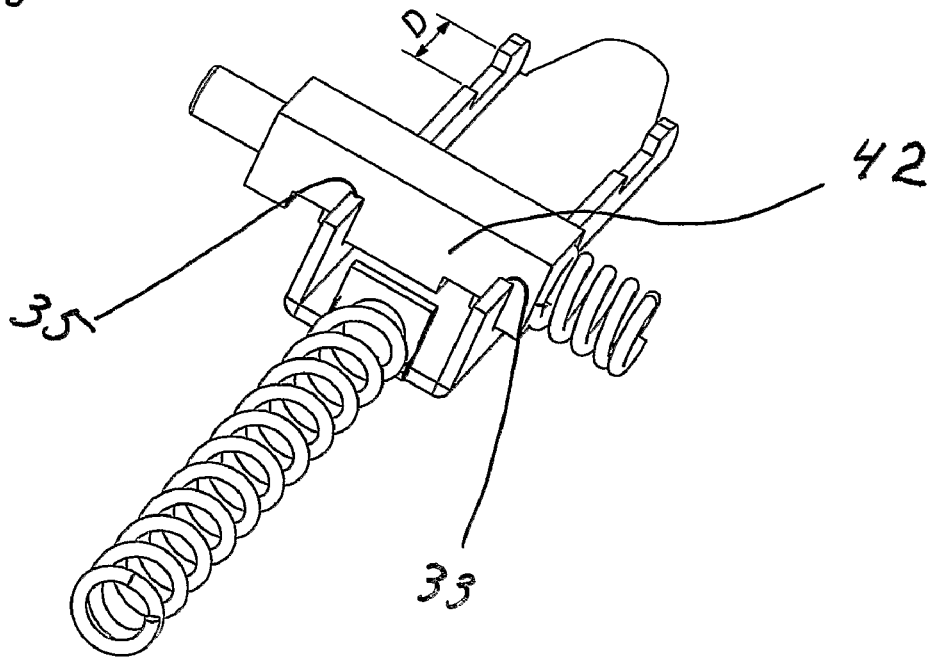
Figure 10:
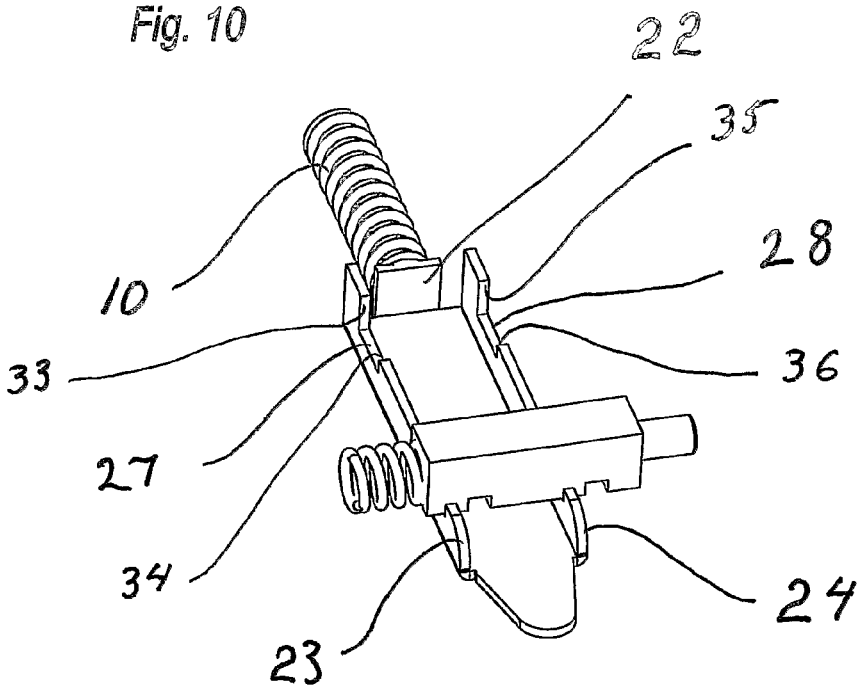
Figure 11:
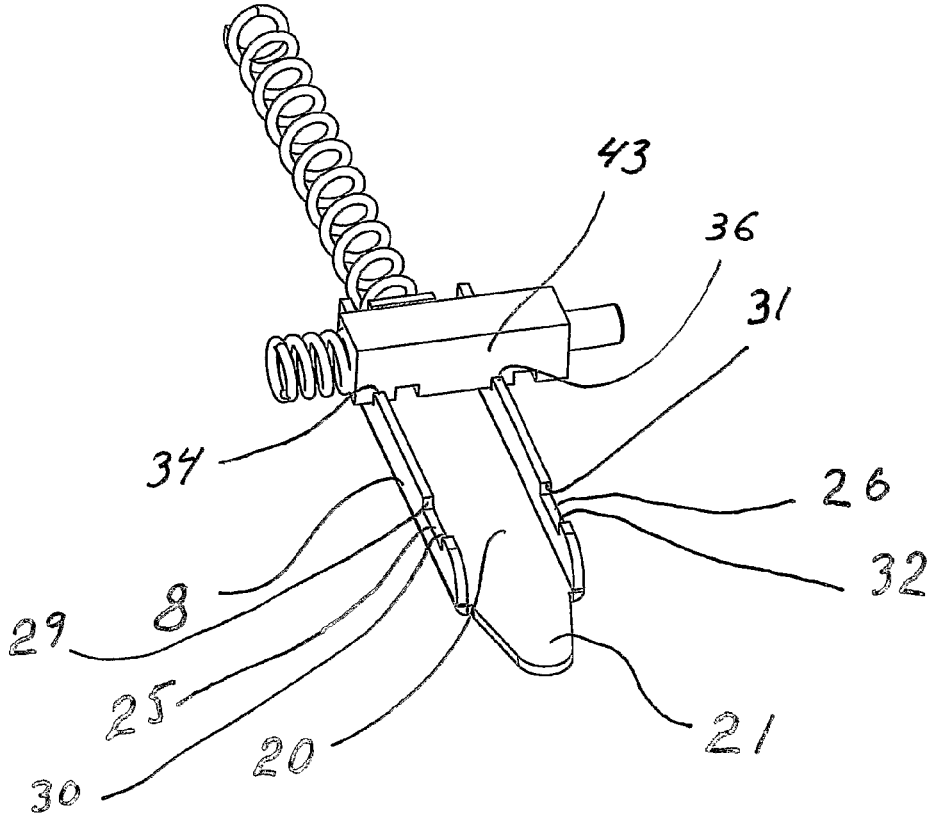
Figure 12:
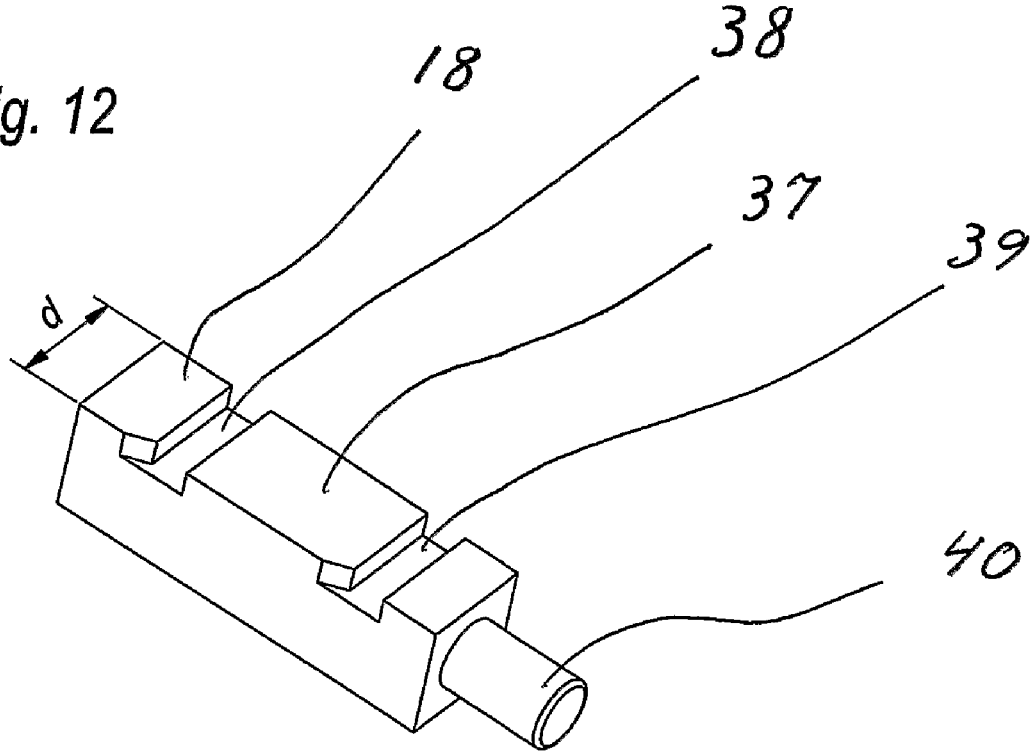
FIG. 12 is a detail view of a part which is an essential component of the invention.

FIGS. 4 and 5 depict the staple remover arrangement 7 in detail. They show a fastening element 11 which is a separate portion of the base part 3 and comprises a first recess 12 extending in the longitudinal direction of the base part, which direction is represented by the double arrow L in FIG. 5, which recess comprises a first section 13 in which a first elastic means 10 in the form of a coil spring is supported, and a second section 14 comprising grooves 15,16 in which the staple remover is accommodated in a manner described in more detail below. A second recess 17 transverse to the direction L extends in the direction represented by the double arrow T. The locking device 9 is supported in this recess and comprises a lockbolt 18 and a second elastic means 19 described in more detail below.

With reference to FIGS. 6-12, the essential component parts of the staple remover arrangement and how they function will now be described in detail. The drawings show the staple remover 8 comprising a bottom part 20 which has at its forward edge a tongue 21 by which a staple is removed. The bottom part has at its rear edge an abutment plate 22 against which the first elastic element in the form of a coil spring 10 abuts. The staple remover is further provided with a first wall 23 directed upwards and a second wall 24. The walls 23 and 24 each comprise a forward recess 25 and 26 respectively and a rear recess 27 and 28 respectively. The recesses 25,26 and 27,28 have the same width D. The forward recesses 25,26 has first impact surfaces 29,30 and 31,32 respectively, the rear recesses 27,28 has second impact surfaces 33,34 and 35,36 respectively. The drawings also show the lockbolt 18 which has a quadrilateral configuration 37 comprising on one side a first slot 38 and a second slot 39. The structure further has on one of its short sides a protrusion 40. The width of the side of the configuration which comprises the slots 38 and 39 is represented by d in FIG. 12 and is somewhat smaller than the width D. The drawings also show the second elastic means 19 in the form of a coil spring in contact with the lockbolt 18.

Figure 3:
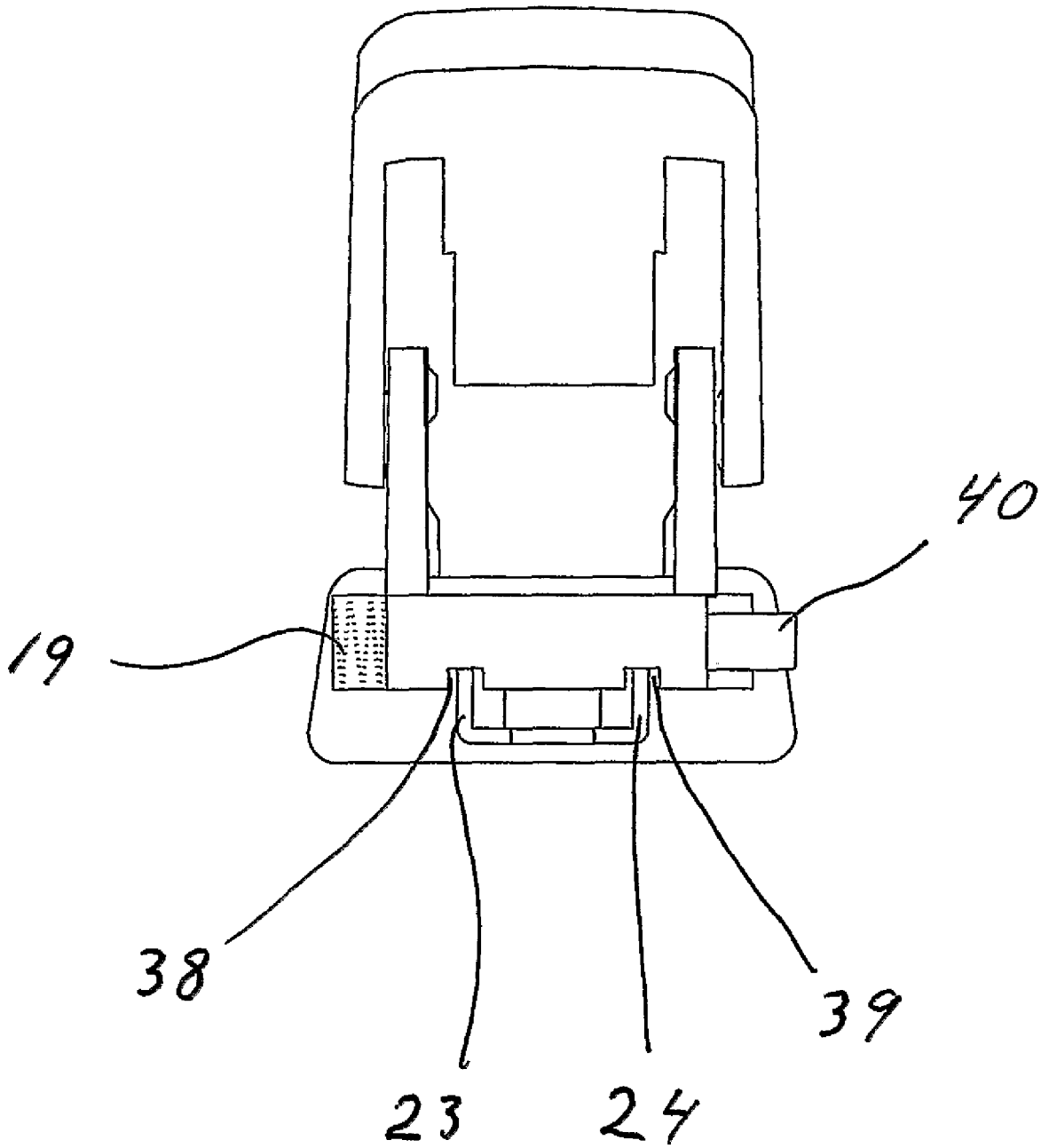
FIG. 3 is a schematic view depicting a stapler seen from the rear.
Figure 13:
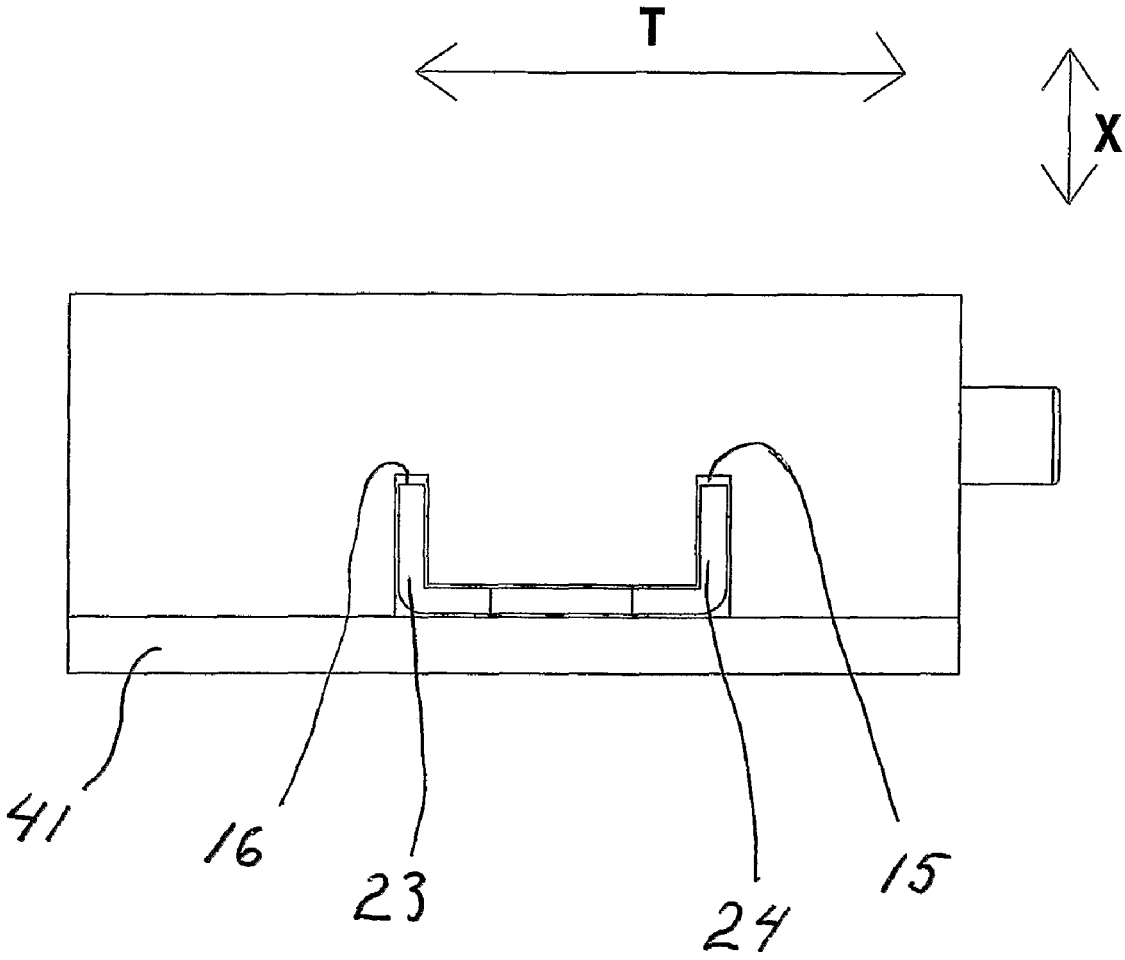
FIG. 13 depicts the base part enlarged as viewed from the rear.

The assembling and function of the staple remover arrangement are described in more detail below with reference to FIGS. 4-12, which show the lockbolt 18 fitted in the second recess 17 with the slots 38 and 39 facing up towards the observer, which is not shown clearly in FIGS. 4 and 5. The second elastic means 19 is also fitted in the same recess and is so positioned and tensioned that it urges the lockbolt in the direction represented by the arrow S in FIG. 4. The protrusion 40 protrudes through an aperture in the element 11 and the lockbolt is movable to and fro in the direction T in FIG. 5 by pressing the protrusion. The staple remover 8 is so disposed across the lockbolt that the walls 23,24 extend down into the grooves 15, 16, as may be seen most clearly in FIG. 13. The first elastic means is situated behind the staple remover and is tensioned when the staple remover is in the retracted position (FIG. 4). When the lockbolt is moved, as described below, to a non-locking position, the staple remover is movable forwards and rearwards in the direction L, which is also the longitudinal direction of the staple remover. A plate 41 depicted in FIG. 13 is placed across the staple remover and the lockbolt and the two elastic means and its main function is to ensure that the parts of the staple remover arrangement are held in place, which plate may be fastened to the element 11 in any desired manner known to one skilled in the art. When the staple remover is in the retracted state as in FIG. 4, the lockbolt is in the position depicted in FIGS. 6 and 10 where the fact that the impact surfaces 29 and 31 meet the side 42 of the lockbolt prevents the staple remover from being pushed by the coil spring 10 to the extended position. Moving the staple remover out to an extended position is effected by pressing the protrusion 40 in against the force exerted by the second coil spring 19 to a position where the respective slots 38 and 39 are so situated that the walls 23,24 can be moved through said slots, as clearly illustrated in the schematic view in FIG. 3. In this situation, the first coil spring 10 pushes the staple remover to an extended position, as in FIGS. 5 and 9, where forward movement of the remover is prevented by the fact that the surfaces 33 and 35 meet the side 42 of the lockbolt, whereupon the protrusion is released and the lockbolt returns to the position depicted in FIG. 11 where the staple remover cannot be moved in its longitudinal direction because of the cooperation between the surfaces 33,34,35,36 of the walls 23,24 and the sides 42 and 43 of the lockbolt 18, as may be seen in FIGS. 9 and 11 taken together. There is thus assurance that the staple remover is secured in its extended position and cannot be dislodged from it until the lockbolt is moved to a position where the walls can run through the slots.

Moving the staple remover from the extended position to the retracted position is effected in a corresponding manner, but if it is not moved to the retracted position where the lockbolt can block it, the staple remover will be pushed by the force exerted by the first coil spring 10 to the extended position and there will therefore be no risk of the staple remover being left in a half-retracted state without this being noticed by the user. Since the locking device cannot be maneuvered by manipulating the staple remover, there is no risk of the locking device opening when the staple remover is being used for its purpose.

FIG. 13 shows that the clearance between the staple remover and the walls surrounding it allows only very limited movement of the staple remover in the directions T and X, which means that the staple remover will be stable even in its extended state.

The invention claimed is:

1. A stapler arrangement including a base part, a magazine part, and a driver operable to drive a staple, the magazine part operable to store at least one staple and operable to be moved toward a workpiece in order to drive the staple through the workpiece and to bend the staple against an anvil coupled to the base part, the stapler comprising:

a built-in staple remover coupled to the base part, the built-in staple remover comprising a staple remover which is movable between a non-operational first position where it is retracted in a stapler body and locked by a locking device and an operational second position where the staple remover is partly extended from the stapler body, a first elastic unit to act on the staple remover and which is tensioned when the staple remover is in a non-operational position and which pushes the staple remover to the operational second position when the locking device is released in the non-operational position, and the locking device is to lock the staple remover in the operational second position.

2. The stapler arrangement according to claim 1, wherein the locking device is moved from a locked position to an unlocked position without the staple remover being manipulated.

3. The stapler arrangement according to claim 2, wherein the first elastic unit moves the staple remover to an extended position if the latter, when pushed in from an extended position, does not reach the non-operational first position.

4. The stapler arrangement according to claim 3, wherein, when the staple remover is in an extended position, the staple remover is operable to be connected to the stapler in such a way that it can only move marginally in directions transverse to its longitudinal direction.

5. The stapler arrangement according to claim 4, wherein the locking device is held in a locked position by a second elastic unit.

6. The stapler arrangement according to claim 5, wherein the first elastic unit includes a coil spring.

7. The stapler arrangement according to claim 1, wherein the first elastic unit moves the staple remover to an extended position if the latter, when pushed in from an extended position, does not reach the non-operational first position.

8. The stapler arrangement according to claim 7, wherein, when the staple remover is in an extended position, the staple remover is connected to the stapler in such a way that it can only move marginally in directions transverse to its longitudinal direction.

9. The stapler arrangement according to claim 8, wherein the locking device is held in a locked position by a second elastic unit.

10. The stapler arrangement according to claim 9, wherein the first elastic unit includes a coil spring.

11. The stapler arrangement according to claim 1, wherein, when the staple remover is in an extended position, the staple remover is operable to be connected to the stapler in such a way that it can only move marginally in directions transverse to its longitudinal direction.

12. The stapler arrangement according to claim 11, wherein the locking device is held in a locked position by a second elastic unit.

13. The stapler arrangement according to claim 12, wherein the first elastic unit includes a coil spring.

14. The stapler arrangement according to claim 1, wherein the first elastic unit includes a coil spring.

15. The stapler arrangement according to claim 1, wherein the locking device is held in a locked position by a second elastic unit.

* * * * *